US012723379B2

(12) United States Patent
Ren et al.

(10) Patent No.: US 12,723,379 B2
(45) Date of Patent: Sep. 1, 2026

(54) STABLE CONNECTION SYSTEM FOR FIXING WORN PART OF EXCAVATION EQUIPMENT AND ASSEMBLY METHOD THEREOF

(71) Applicant: NINGBO HESHUN NEW MATERIALS CO., LTD., Ningbo (CN)

(72) Inventors: Meikang Ren, Ningbo (CN); Hui Li, Ningbo (CN)

(73) Assignee: NINGBO HESHUN NEW MATERIALS CO., LTD., Ningbo (CN)

( * ) Notice: Subject to any disclaimer, the term of this patent is extended or adjusted under 35 U.S.C. 154(b) by 343 days.

(21) Appl. No.: 18/613,050

(22) Filed: Mar. 21, 2024

(65) Prior Publication Data

US 2025/0230638 A1 Jul. 17, 2025

Related U.S. Application Data

(63) Continuation of application No. PCT/CN2024/079264, filed on Feb. 29, 2024.

(30) Foreign Application Priority Data

Jan. 17, 2024 (CN) ..... 202410068311.5

(51) Int. Cl.
*E02F 9/28* (2006.01)

(52) U.S. Cl.
CPC ..... *E02F 9/2833* (2013.01)

(58) Field of Classification Search
CPC ..... E02F 9/2808; E02F 9/2833; E02F 9/2816; E02F 9/2825; E02F 9/2841
See application file for complete search history.

(56) References Cited

U.S. PATENT DOCUMENTS 5,410,826 A * 5/1995 Immel ..... E02F 9/2833 37/457
5,452,529 A * 9/1995 Neuenfeldt ..... E02F 9/2825 37/395

(Continued)

FOREIGN PATENT DOCUMENTS

CN 1780964 B 5/2006
CN 101680210 B 3/2010

(Continued)

*Primary Examiner* — Adam J Behrens
(74) *Attorney, Agent, or Firm* — JEEN IP LAW, LLC

(57) ABSTRACT

A stable connection system for fixing a worn part of an excavation equipment and an assembly method thereof are provided, the connection system includes a worn part, a lip plate, a backrest component, and a rotating locking pin; a fitting part is provided on the backrest component or lip plate, the fitting part is provided with a second parallel thread; the rotating locking pin includes a connection portion providing with a first parallel thread on a lower and a taper portion on an upper; the rotating locking pin is provided between the backrest component and the lip plate, the connection portion and the fitting part are connected in an insertion manner and twisted in a thread manner; the rotating locking pin rotates and moves axially. The taper portion compresses the backrest component and the lip plate so as to fix the worn part on the lip plate.

9 Claims, 13 Drawing Sheets

(56) References Cited

U.S. PATENT DOCUMENTS

| | | | | | |
|---|---|---|---|---|---|
| 5,564,206 | A * | 10/1996 | Ruvang | E02F 9/2833 | 37/456 |
| 5,638,621 | A * | 6/1997 | Keech | E02F 9/2833 | 37/456 |
| 6,301,810 | B1 * | 10/2001 | Fidler | E02F 9/2825 | 37/458 |
| 7,171,771 | B2 * | 2/2007 | Briscoe | E02F 9/2841 | 37/456 |
| 7,526,886 | B2 * | 5/2009 | McClanahan | E02F 9/2883 | 37/456 |
| 8,898,937 | B2 * | 12/2014 | Campomanes | E02F 9/2833 | 37/456 |
| 8,978,277 | B2 * | 3/2015 | Knight | E02F 9/2891 | 37/456 |
| 9,228,325 | B2 * | 1/2016 | Campomanes | E02F 9/2825 | |
| 9,353,505 | B2 * | 5/2016 | Pilon | E02F 9/2883 | |
| 11,286,651 | B2 * | 3/2022 | Rol Corredor | E02F 9/2833 | |
| 12,553,222 | B2 * | 2/2026 | Hankland | E02F 9/2825 | |
| 2004/0216334 | A1 * | 11/2004 | Emrich | E02F 9/2883 | 37/452 |
| 2004/0221491 | A1 * | 11/2004 | Briscoe | E02F 9/2833 | 37/452 |
| 2007/0137071 | A1 * | 6/2007 | McClanahan | E02F 9/2833 | 37/452 |
| 2008/0092412 | A1 * | 4/2008 | McClanahan | E02F 9/2841 | 37/451 |
| 2011/0072693 | A1 * | 3/2011 | Knight | E02F 9/2825 | 37/456 |
| 2015/0096207 | A1 * | 4/2015 | Tasovski | E02F 9/2825 | 37/456 |
| 2015/0197921 | A1 | 7/2015 | Campomanes | | |
| 2015/0218782 | A1 * | 8/2015 | Quarfordt | E02F 9/2825 | 37/455 |
| 2022/0325505 | A1 * | 10/2022 | Johnston | E02F 9/2833 | |
| 2022/0403629 | A1 * | 12/2022 | Ruvang | E02F 9/2841 | |
| 2023/0058442 | A1 * | 2/2023 | Baril | E02F 9/2825 | |
| 2025/0092646 | A1 * | 3/2025 | Ruvang | E02F 9/2825 | |

FOREIGN PATENT DOCUMENTS

| | | | | | |
|---|---|---|---|---|---|
| CN | 101824835 | B | 9/2010 | | |
| CN | 105569113 | A * | 5/2016 | E02F 9/2816 | |
| CN | 211447085 | U | 9/2020 | | |
| CN | 115427642 | B | 12/2022 | | |
| CN | 117569407 | B | 2/2024 | | |
| EP | 3498923 | A1 | 6/2019 | | |

* cited by examiner

STABLE CONNECTION SYSTEM FOR FIXING WORN PART OF EXCAVATION EQUIPMENT AND ASSEMBLY METHOD THEREOF

CROSS-REFERENCE TO RELATED APPLICATIONS

This application is a continuation of International Application No. PCT/CN2024/079264, filed on Feb. 29, 2024, which claims priority to Chinese Patent Application No. 201410068311.5, filed on Jan. 17, 2024, both of which are hereby incorporated by reference in their entireties.

TECHNICAL FIELD

The present disclosure relates to the field of connection system for worn parts of excavation equipment technologies, and in particular, to a stable connection system for a worn part that can quickly separate and assemble the worn part from a lip plate body of an excavation equipment.

BACKGROUND

Excavation equipment is commonly used in engineering and mining industries, an excavator bucket is an important component of the excavation equipment. Excavation equipment often collides with stones and soil during an excavation operation, so that a worn-resistant component needs to be installed at a forefront thereof.

Patent of CN211447085U discloses a fixing device for a worn-resistant component, which includes a first fixing component, a second fixing component, and an adjustment mechanism. An end of the adjustment mechanism is provided with an adjustment groove, a fourth thread portion inserted in a fourth groove has a rod part, which extends from the adjustment groove. By rotating the rod portion, the fourth thread portion can rotate synchronously. In a practical operation, an operator can use an installation tool to rotate the rod at the adjustment groove, which causes the fourth thread portion to rotate. The fourth thread portion and a second gear part can move an adjustment mechanism up and down in an installation direction through a thread meshing. This structure has high requirements for thread fit, the transmission efficiency is relatively low, which is quite laborious.

Patent with an announcement number of CN101824835B discloses a detachable connection component, which includes a lock for a wedge and a tube to securely fix a separated element of the component together in a loose manner. The wedge is thread connected to the tube and can be driven in and out of an opening of the component without a need for a hammer or pry. A direct connection between the wedge and the tube does not require a bolt, a washer, a nut, and other hardware, thereby reducing the number of components. However, a fit between a buckle and the thread keeps it constantly rubbing and squeezing, which renders it prone to worn.

SUMMARY

In response to the problems in existing technology, an embodiment provides a stable connection system with a high transmission efficiency, easy and convenient installation, and good stability for fixing a worn part of an excavation equipment, and a corresponding assembly method is provided.

The technical solution adopted by the present disclosure to solve the above-mentioned technical problem is a stable connection system for fixing a worn part of an excavation equipment, including: a worn part, a lip plate body, a front-rest component, a backrest component, and a rotating locking pin;

the worn part is provided with a connection groove with a rear opening and a first hole extending up and down;

the lip plate body is provided with a second hole extending up and down, an axis direction of the second hole is the same as that of the first hole;

a front end of the lip plate body extends into the connection groove; the second hole forms a hole portion in the first hole;

the front-rest component and the backrest component are provided in the hole portion and form a pin channel between the two;

the rotating locking pin includes a connection portion providing with a first parallel thread and a taper portion with an outer diameter gradually decreasing from a top to a bottom;

a rear of the front-rest component is provided with a fitting part, which is provided with a second parallel thread;

the rotating locking pin is provided in the pin channel through the hole portion, the connection portion and the fitting part are connected in an insertion manner and twisted in a thread manner;

the rotating locking pin rotates and moves axially in the pin channel, the taper portion compresses the front-rest component and backrest component so that front-rest component abuts forward against the lip plate body and the backrest component abuts backward against the worn part, thereby fixing the worn part on the lip plate body.

In an embodiment of the present disclosure: the front-rest component includes an upper cross arm, a vertical arm, and a lower cross arm, a rear end of the upper cross arm is connected to an upper end of the vertical arm, a lower end of the vertical arm is connected to a rear end of the lower cross arm to form a half-frame structure;

a lower section at a rear of the vertical arm protrudes backwards to form the fitting part, an upper section at the rear of the vertical arm is provided with an acting surface;

the vertical arm passes through the second hole, the upper cross arm is provided between an upper surface of the lip plate body and an upper groove wall of the connection groove, the lower cross arm is provided between a lower surface of the lip plate body and a lower groove wall of the connection groove;

the taper portion compresses the acting surface. of the vertical arm, a front side of the vertical arm abuts against an inner wall of the second hole.

In an embodiment of the present disclosure: the fitting part is provided with a threaded hole with the second parallel thread; the connection portion is a cylindrical component, the first parallel thread is provided on an outer circumferential surface of the cylindrical component;

or the fitting part is provided with a cylindrical component, the second parallel thread is provided on an outer circumferential surface of the cylindrical component, the connection portion is a threaded hole with the first parallel thread at a lower end of the rotating locking pin.

In an embodiment of the present disclosure: a first concave conical surface is provided on a rear side of the front-rest component; a front side of the backrest component is provided with a second concave conical surface; tapers of the first concave conical surface and the second concave conical surface are consistent with that of the taper portion;

an outer circumference of the taper portion of the rotating locking pin is distributed with multiple strip-shaped concave grooves that are extending longitudinally, a groove surface of the strip-shaped concave groove transitions to an outer circumference of the taper portion in a circular arc; the second concave conical surface of the backrest component is provided with a protruding elastic locking buckle; a head of the elastic locking buckle is provided with a tongue-shaped slope to render it difficult to rotate in an opposite direction;

in a first state, when the rotating locking pin is subjected to an external circumferential force, the elastic locking buckle slides along the groove surface and enters an adjacent strip-shaped concave groove;

in a second state, when the external circumferential force is removed, the elastic locking buckle is clamped into a specific strip-shaped groove to limit a rotation of the rotating locking pin.

In an embodiment of the present disclosure: a rear inner wall of the first hole is provided with a first protrusion on an upper side of the connection groove and a second protrusion on a lower side of the connection groove;

the backrest component includes a vertical support wall, an upper limit wall and a lower limit wall provided at an upper end and a lower end of the vertical support wall;

the vertical support wall abuts against front-end faces of the first protrusion and the second protrusion, the upper limit wall is provided at an upper side of the first protrusion, the lower limit wall is provided at a lower side of the second protrusion.

In an embodiment of the present disclosure: an upper side of the backrest component is provided with a "7"-shaped member that extends out of the first hole for easy to clamp a tool.

In an embodiment of the present disclosure: the fitting part is provided with a nut seat, which is provided with an accommodation chamber; an upper side of the accommodation chamber is provided with an upper seat wall, a lower side of the accommodation chamber is provided with a lower seat wall;

the accommodation chamber is provided with a stabilizing nut that can limit a movement range, the stabilizing nut is limited between the upper seat wall and the lower seat wall; or the accommodation chamber is provided with a stabilizing screw that can limit a movement range, a nut of the stabilizing screw is limited between the upper seat wall and the lower seat wall.

In an embodiment of the present disclosure: the front-rest component includes a fixed member on a front side and a first rotating support member on a rear side; the backrest component includes a second rotating support member on a front side and an insertion member on a rear side;

the rotating locking pin compresses the first and second rotating support members, the first rotating support member compresses the fixed member, the fixed member compresses the lip plate body, the second rotating support member compresses the insertion member backwards, and the insertion member compresses the worn part backwards.

In an embodiment of the present disclosure: a stabilizing groove is provided on a rear of the worn part; upper and lower sides of the lip plate body are respectively fixedly provided with a stabilizing block;

the stabilizing block is embedded in the stabilizing groove to stabilize the worn part.

In an embodiment of the present disclosure: a stable connection system for fixing a worn part of an excavation equipment, where an assemble object includes a worn part, a lip plate, a backrest component, and a rotating locking pin;

the worn part is provided with a connection groove with a rear opening and a first installation hole extending up and down, the lip plate is provided with a second installation hole extending up and down, an axial direction of the second installation hole is same as that of the first installation;

a front end of the lip plate extends to the connection groove, the second installation hole is provided in the first installation hole;

the backrest component passes through the first installation hole and the second installation, the backrest component or the lip plate is provided with a fitting part provided at a lower of the second installation hoe, the fitting part is provided with a second parallel thread;

the rotating locking pin includes a connection portion provided with a first parallel thread at a lower side and a taper portion with an outer diameter gradually decreasing from a top to a bottom;

a first slop plane is provided at one side of the second installation hole of the lip plate that is relative to the backrest component, a front side of the backrest component is provided with a second slop plane, inclinations of the first slop plane and the second slop plane are consistent with that of the taper portion;

the rotating locking pin is provided between the backrest component and the lip plate through the first installation hole and the second installation hole, the connection portion and the fitting part are connected in an insertion manner and twisted in a thread manner;

the rotating locking pin rotates and moves axially, the taper portion compresses the front-rest component and the backrest component due to an expansion of a taper so to fix the worn part on the lip plate body.

In an embodiment of the present disclosure, an inner wall of a rear side of the first installation hole is provided with a first protrusion provided at an upper side of the connection groove and a second protrusion at a lower side of the connection groove;

the backrest component includes a vertical support wall, an upper limit wall and a lower limit wall providing at upper and lower ends of the vertical support wall;

the vertical support wall abuts against front end faces of the first and the second protrusions, the upper limit wall is provided on an upper of the first protrusion, the lower limit wall is provided at a lower of the second protrusion.

In an embodiment of the present disclosure, a first concave conical surface is provided on one side of the second installation hole of the lip plate that is relative to the backrest component, a front side of the backrest component is provided with a second concave conical surface; tapers of the first concave conical surface and the second concave conical surface are consistent with that of the taper portion;

an outer circumference of the taper portion of the rotating locking pin is distributed with multiple strip-shaped concave grooves that are extending longitudinally, a groove surface of the strip-shaped concave groove transitions to an outer circumference of the taper portion in a circular arc; the second concave conical surface of the backrest component is provided with a protruding elastic locking buckle; a head of the elastic locking buckle is provided with a tongue-shaped slope to render it difficult to rotate in an opposite direction;

in a first state, when the rotating locking pin is subjected to an external circumferential force, the elastic locking buckle slides along the groove surface and enters an adjacent strip-shaped concave groove;

in a second state, when the external circumferential force is removed, the elastic locking buckle is clamped into a specific strip-shaped groove to limit a rotation of the rotating locking pin.

In an embodiment of the present disclosure, the lip plate includes a lip plate body and a front-rest component, the lip plate body is provided with a second hole, the front-rest component passes through the second hole and abuts against the lip plate body;

a pin channel is formed between the front-rest component and the backrest component that the rotating locking pin to pass though;

the rotating locking pin is twisted to expand the front-rest component and the backrest component outwardly so as to achieve the fixing of the worn part on the lip plate body.

In an embodiment of the present disclosure, the fitting part is provided with a threaded hole with the second parallel thread; the connection portion is a cylindrical component, the first parallel thread is provided on an outer circumferential surface of the cylindrical component;

or the fitting part is provided with a cylindrical component, the second parallel thread is provided on an outer circumferential surface of the cylindrical component, the connection portion is a threaded hole with the first parallel thread at a lower end of the rotating locking pin.

In an embodiment of the present disclosure, the fitting part is provided with a nut seat, which is provided with an accommodation chamber; an upper side of the accommodation chamber is provided with an upper seat wall, a lower side of the accommodation chamber is provided with a lower seat wall;

the accommodation chamber is provided with a stabilizing nut that can limit a movement range, the second parallel threaded is provided in a screw hole of the stabilizing nut, the stabilizing nut is limited between the upper seat wall and the lower seat wall; or the accommodation chamber is provided with a stabilizing screw that can limit a movement range, the second parallel thread is provided on a bolt of the stabilizing screw, a nut of the stabilizing screw is limited between the upper seat wall and the lower seat wall.

In an embodiment of the present disclosure: the front-rest component includes an upper cross arm, a vertical arm, and a lower cross arm, a rear end of the upper cross arm is connected to an upper end of the vertical arm, a lower end of the vertical arm is connected to a rear end of the lower cross arm to form a half-frame structure;

a lower section at a rear of the vertical arm protrudes backwards to form the fitting part, an upper section at the rear of the vertical arm is provided with an acting surface. that is squeezed by the taper portion;

the vertical arm passes through the second hole, the upper cross arm is provided between an upper surface of the lip plate body and an upper groove wall of the connection groove, the lower cross arm is provided between a lower surface of the lip plate body and a lower groove wall of the connection groove;

an interior of the worn part is respectively provided with an upper concave portion matching with the upper cross arm and a lower concave portion matching with the lower cross arm, and a fitting clearance is provided between the upper cross arm, the lower cross arm with the worn part;

a first concave portion is provided at front corners of the upper cross arm and the vertical arm and front corners of the lower cross arm and the vertical arm.

In an embodiment of the present disclosure: the worn part is an U-shape, which includes an upper branch and a lower branch, a connection groove is formed between the upper branch and the lower branch;

a stabilizing groove is provided on rears of the upper branch and the lower branch; upper and lower sides of the lip plate are respectively fixed with a stabilizing block;

the stabilizing block is embedded in the stabilizing groove to stabilize the worn part.

In an embodiment of the present disclosure: an assembly method for a stable connection system for fixing a worn part of an excavation equipment: where an assembly object includes a worn part, a lip plate, a backrest component, and a rotating locking pin;

the worn part is provided with a connection groove with a rear opening and a first installation hole that extends up and down, the lip plate is provided with a second installation hole that extends up and down;

the rotating locking pin includes a connecting portion with a first parallel thread provided at a lower side and a taper portion with an outer diameter gradually decreasing from a top to a bottom;

a fitting part is provided on the backrest component or the lip plate, the fitting part is provided with a fine-tuning component for adjusting a movement range, the fine-tuning component is provided with a second parallel thread that matches the first parallel thread;

an outer circumference of the taper portion of the rotating locking pin is distributed with multiple strip-shaped concave grooves that are extending longitudinally, a protruding elastic locking buckle is provided on a front of the backrest component;

an assembly steps include:

step S1: inserting a front end of the lip plate into the connection groove, the second installation hole being positioned in the first installation hole;

step S2: the backrest component passing through the first and second installation holes, the backrest component being positioned at rear parts of the first and second installation holes, a pin channel is formed between the backrest component and a hole wall of the second installation hole of the lip plate, the fitting part being positioned at a lower part of the pin channel;

step S3: the rotating locking pin passing through the first installation hole and the second installation hole and being provided in the pin channel in a way that the connection portion is provided at a lower; the connection portion and the fine-tuning component of the fitting part are adaptively inserted and twisted in a thread manner;

step S4: the rotating locking pin rotating and moving axially, the taper portion compressing the backrest component and the lip plate due to an expansion of a taper, an elastic locking buckle entering a strip-shaped concave groove and switching between different strip-shaped concave grooves with a rotation of the elastic locking buckle; the worn part being fixed on the lip plate.

In an embodiment of the present disclosure: in the assembly object, the lip plate includes a lip plate body, and a front-rest component, the lip plate body is provided with a second hole;

the front-rest component includes an upper cross arm, a vertical arm, and a lower cross arm, a rear end of the upper cross arm is connected to an upper end of the vertical arm, a lower end of the vertical arm is connected to a rear end of the lower cross arm to form a half-frame structure;

a lower section at a rear of the vertical arm protrudes backwards to form the fitting part, an upper section at the rear of the vertical arm is provided with an acting surface, which is a first concave conical surface;

a rear inner wall of the first installation hole is provided with a first protrusion provided on an upper side of the connection groove and a second protrusion provided on a lower side of the connection groove;

the backrest component includes a vertical support wall, an upper limit wall and a lower limit wall provided at an upper end and a lower end of the vertical support wall, a front side of the vertical support wall is a second concave conical surface;

in the assembly steps, step S0 is included before step S1;

in step S0, the vertical arm of the front-rest component passing through the second hole, the upper cross arm being positioned on an upper side of the lip plate body, the lower cross arm being positioned on a lower side of the lip plate body, a front side of the vertical arm abutting against an inner wall of the second hole, the front-rest component and the lip plate body jointly forming the lip plate;

in step S2, the vertical support wall abutting against front end faces of the first protrusion and the second protrusion, the upper limit wall being positioned on an upper side of the first protrusion, the lower limit position wall being positioned on a lower side of the second protrusion; the first concave conical surface of the vertical arm and the second concave conical surface of the vertical support wall forming the pin channel.

In an embodiment of the present disclosure: in the assembly object, a stabilizing groove is provided on a rear side of the worn part; a bottom surface of the stabilizing groove is a first fitting slope inclined from back to front near the connection groove, a side surface of the stabilizing groove is a second fitting slope gradually expanding outwardly towards a direction of the lip plate; upper and lower sides of the lip plate are respectively provided with a stabilizing block;

in the assembly step, the stabilizing block is pre-fixed on the lip plate before step S1; when the lip plate is inserted into the connection groove, the stabilizing block is embedded in the stabilizing groove; or the stabilizing block is inserted into the stabilizing groove after step S4, and then fixed with the lip plate.

Compared with existing technology, the advantages of the present disclosure are:

a transmission of a first parallel thread and a second parallel thread is used to achieve an axial movement of a rotating locking pin, a transmission efficiency is high. A meshing of the first parallel thread and the second parallel thread can limit an axial displacement of the rotating locking pin due to up and down vibrations in use on the basis of a tightening of the taper, thereby ensuring a stability of the connection.

In an embodiment, a fine-tuning component has a certain degree of movement within a nut seat, which includes slight movement in horizontal and vertical directions. This allows for adaptive positioning during a downward rotation and insertion of a rotating locking pin, allowing for a thread fit. It also allows for adaptive fine-tuning of a relative position after a corresponding component is supported and displaced, thereby ensuring an adaptability and stability of a thread connection.

In an embodiment, a first concave conical surface and a second concave conical surface wrap around an outer circumference surface of the taper portion of the rotating locking pin, which is conducive to improving the connection stability. A combination of a strip-shaped concave groove and an elastic locking buckle further restricts a circumferential rotation of a rear part and the rotating locking pin without an external circumferential rotation force, achieving an effect of preventing a loosening of the rotating locking pin and improving a firmness of the connection of a worn part. Furthermore, a tongue-shaped slope of an elastic locking buckle head can prevent the reversal of the rotating locking pin, reduce looseness during use, and further improve stability.

BRIEF DESCRIPTION OF DRAWINGS

The following will provide a further detailed description of the present disclosure in combination with the drawings and preferred embodiments. However, those skilled in the art will appreciate that these drawings are only drawn for a purpose of explaining the preferred embodiments and should not be used as a limitation on the scope of the present disclosure. In addition, unless otherwise specified, the drawings only represent a composition or construction of the described object conceptually and may contain exaggerated displays, and the drawings are not necessarily drawn to in a ratio.

Figure 1:
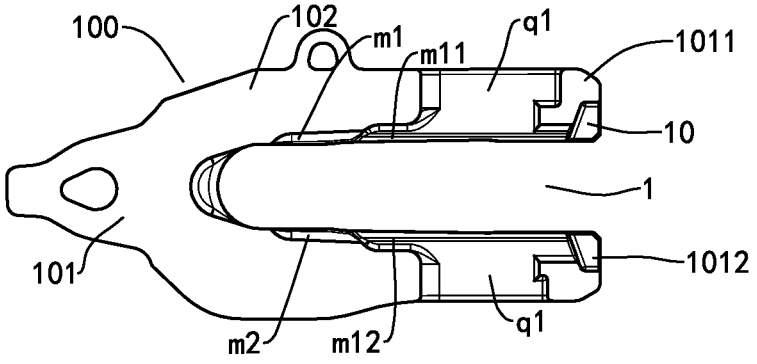
FIG. 1 is a schematic diagram of a worn part in Embodiment 1 of the present disclosure.

Numeral reference: Worn part 100; Lip plate 200; Backrest component 300; Rotating locking pin 400; Connection groove 1; Tooth tip 101; Connection body 102; First hole q1; Lip plate body 201; Front-rest component 202; Pin channel 2; Fitting part 3; Connection portion 4; Taper portion 5; Twisting portion 9; First protrusion 6; Second protrusion 7; Vertical support wall 301; Upper limit wall 302; Lower limit wall 303; Second concave part r1; First concave part r2; First concave conical surface p1; Second concave conical surface p2; Upper cross arm 21; Vertical arm 22; Lower cross arm 23; Upper groove wall m1; Lower groove wall m2; Upper edge x1; Lower edge x2; Upper concave portion m11; Lower concave portion m12; First parallel thread y1; Second parallel thread y2; "7"-shaped member t; Strip-shaped concave groove 51; Elastic locking buckle 52; Elastic member 521; Metal lock part 522; Groove F; Tongue-shape slope e; Nut seat 31; Accommodation chamber c; Upper seat wall c1; Lower seat wall c2; Stabilizing nut 8; Circular lower end surface n; Upper branch 1011; Lower branch 1012; Stabilizing groove 10; Stabilizing block 11; First fitting slope g1; Second fitting slope e g2; Third fitting slope g3; Fourth fitting slope g4; Small-sized portion 111; Large-sized portion 112; Fixed member 202*a*; First rotating support member 202*b*; Second rotating support member 300*a*; Insertion member 300*b*; Extending protrusion z; Stabilizing screw 8'; Nut 81; Screw 82.

DESCRIPTION OF EMBODIMENTS

Preferred embodiments of the present disclosure will be described in detail below with reference to the drawings. Technicians in this field will understand that these descriptions are only descriptive, exemplary, and should not be interpreted as limiting the protection scope of the present disclosure.

In the description of the present disclosure, it should be noted that an orientation or positional relationship indicated by terms "up", "down", "front", "back", "inside", "outside", etc. is based on an orientation or positional relationship shown in the drawings, or is the orientation or positional relationship habitually placed when a product of the disclosure is used. This is only for a convenience of describing the present disclosure and simplifying the description, rather than indicating or implying that the device or component referred to must have a specific orientation, be constructed and operated in a specific orientation, it cannot be understood as a limitation of the present disclosure. Terms "first", "second", etc. are only used for easy understanding the descriptions and have no other directional meanings, and cannot be used as limitations on the present disclosure.

Embodiment 1

As shown in FIGS. 1-25, this embodiment provides a stable connection system for fixing a worn part of an excavation equipment.

As shown in FIGS. 13-17, the stable connection system includes a worn part 100, a lip plate 200, a backrest component 300, and a rotating locking pin 400.

The worn part 100 serves as a forefront of excavation operations and is a component that directly interacts with an excavated material. Therefore, it needs to be firmly connected to a main equipment during use and easy to disassemble during replacement. Therefore, high requirements have been put forward for the connection system.

Figure 2:
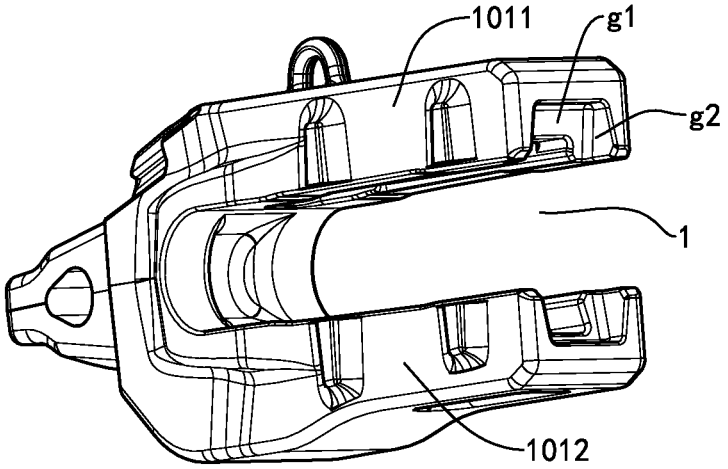
FIG. 2 is a schematic diagram of the worn part in Embodiment 1 of the present disclosure.

As shown in FIGS. 1-2, the worn part 100 is provided with a connection groove 1 with a rear opening, which is configured to extend the lip plate 200 of the equipment to achieve a fitting of the two. The worn part 100 includes a solid tooth tip 101 provided at a front and a connection body 102 provided at a rear with the connection groove 1 axially facing backwards. A first hole q1 extending up and down is provided on the connection body 102. The first hole q1 penetrates through the connection groove 1 to form a first installation hole.

Figure 3:
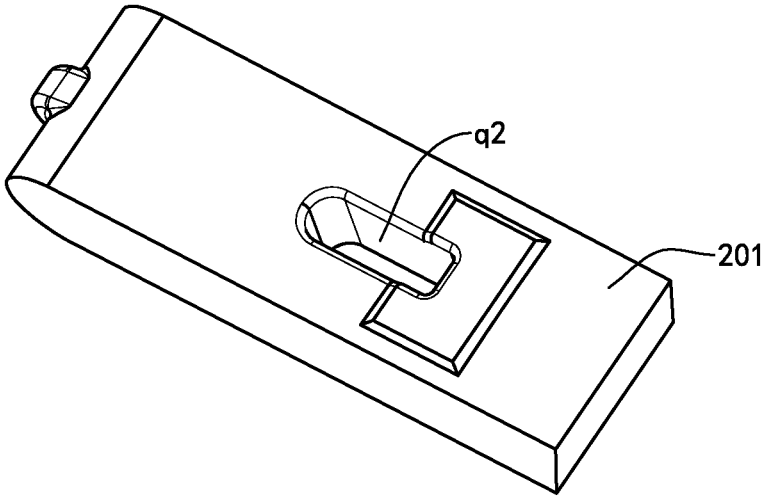
FIG. 3 is a schematic diagram of a lip plate body in Embodiment 1 of the present disclosure.
Figure 4:
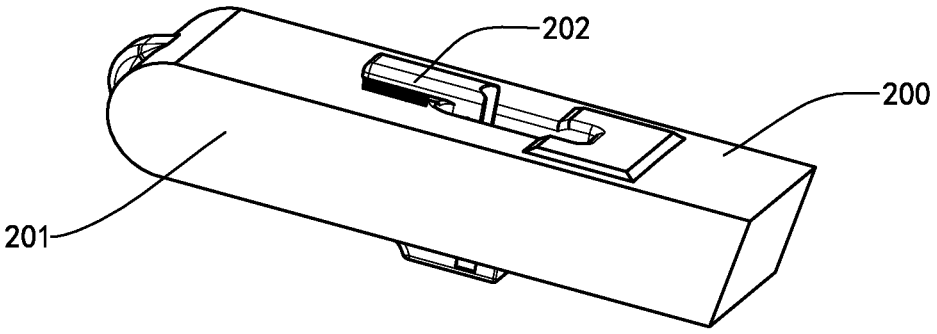
FIG. 4 is a structural schematic diagram the lip plate in Embodiment 1 of the present disclosure.
Figure 5:
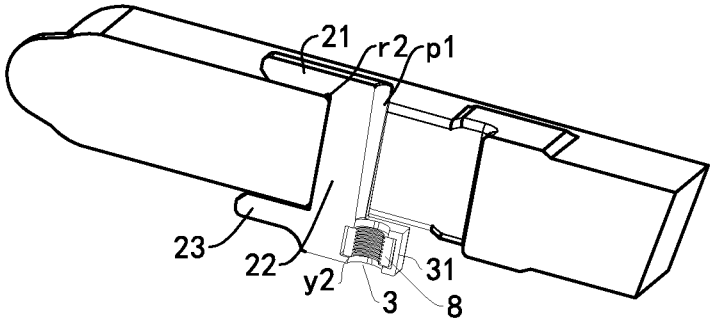
FIG. 5 is a cross-sectional schematic diagram of the lip plate in Embodiment 1 of the present disclosure.

As shown in FIGS. 3-5, the lip plate 200 includes a lip plate body 201 and a front-rest component 202. The lip plate body 201 is provided with a second hole q2, which has a same axis direction as that of the first hole q1.

As shown in FIGS. 3-5, the front-rest component 202 passes through the second hole q2 on the lip plate body 201 and leans against the lip plate body 201. The front-rest component 202 and the lip plate body 201 can be integrated or pre-fixed to form the lip plate 200 through welding or other ways, or they can be separated structures. The front-rest component 202 is combined with a front section of the lip plate body 201 in an abutting against manner. After the fitting of the lip plate body 201 and the front-rest component 202, the second hole q2 is partially occupied to form a second installation hole.

As shown in FIGS. 3-8, a front end of the lip plate body 201 extends into the connection groove 1. The second hole q2 forms a hole portion in the first hole q1. A longitudinal space of the first hole q1 is greater than the longitudinal space of the second hole q2, thereby forming a longitudinal hole structure.

As shown in FIGS. 7-11, the backrest component 300 passes through the first and second installation holes and is located at rear positions of the first and second installation holes, and will ultimately be abutted against a hole wall at a rear of the first installation hole. A pin channel 2 is formed between the front-rest component 202 and the backrest component 300 for the rotating locking pin 400 to pass through, that is, the pin channel 2 is formed between the backrest component 300 and a front inner wall of the second installation hole.

As shown in FIGS. 7-11, in this embodiment, a lower end of the front-rest component 202 is provided with a fitting part 3 provided on a lower side of the second installation hole, which is provided at a lower side of the pin channel 2 for matching with a lower end of the rotating locking pin 400.

Figure 19:
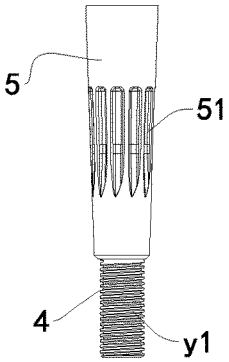
FIG. 19 is a structural schematic diagram of the rotating locking pin in Embodiment 1 of the present disclosure.
Figure 20:
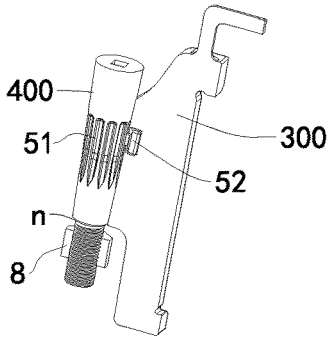
FIG. 20 is a schematic diagram of a fitting between the rotating locking pin and the backrest component in Embodiment 1 of the present disclosure.

As shown in FIG. 19, the rotating locking pin 400 includes a connection portion 4 with a first parallel thread y1 and a taper portion 5 with an outer diameter gradually decreasing from a top to a bottom.

Figure 8:
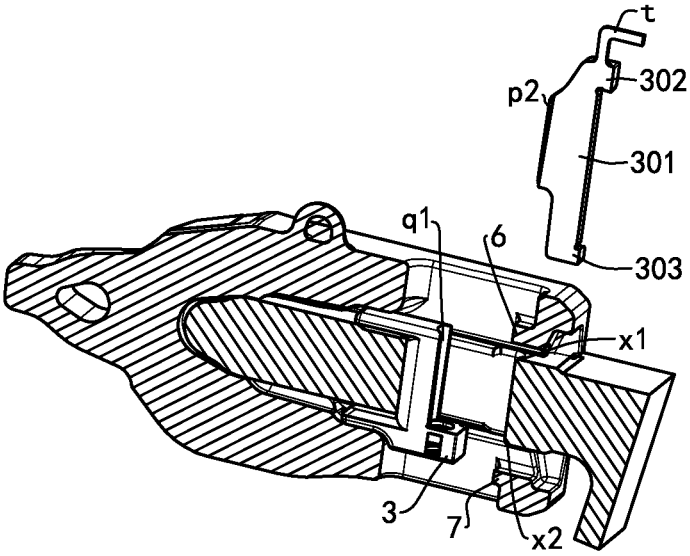
FIG. 8 is a sectional view of the backrest component in the insertion state in Embodiment 1 of the present disclosure.
Figure 10:
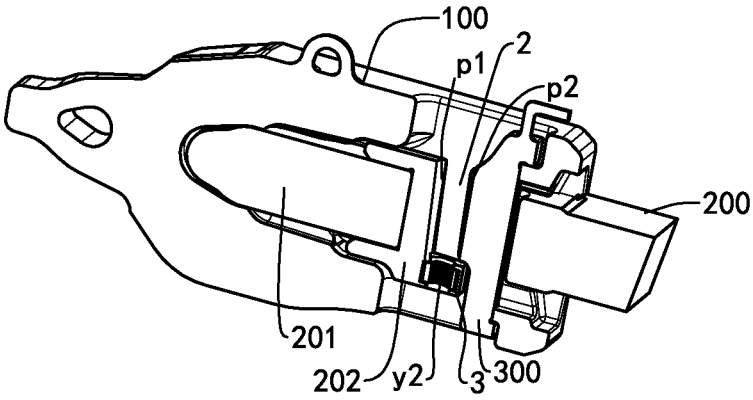
FIG. 10 is an internal structure diagram of the backrest component after being inserted in Embodiment 1 of the present disclosure.
Figure 18:
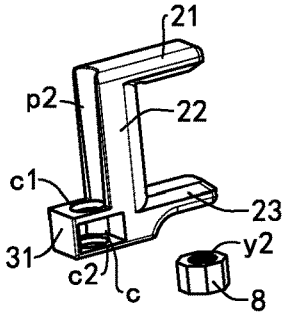
FIG. 18 is a schematic diagram of a decomposition structure of a front-rest component in Embodiment 1 of the present disclosure.

As shown in FIGS. 8, 10, and 18, the fitting part 3 is provided with a second parallel thread y2. The first parallel thread y1 and the second parallel thread y2 are mutually matched internal and external thread structures.

Figure 11:
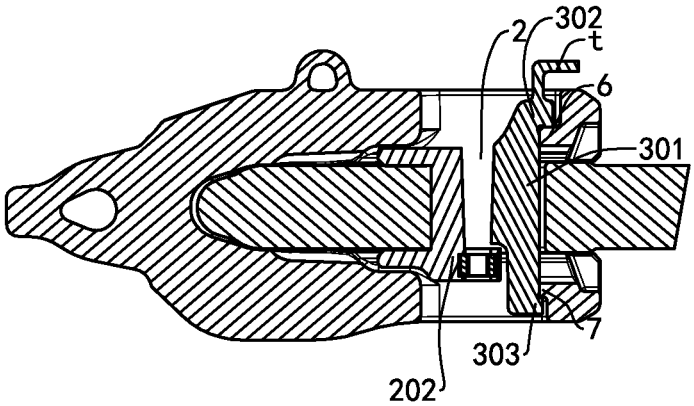
FIG. 11 is a sectional view of the backrest component after being inserted in Embodiment 1 of the present disclosure.

As shown in FIG. 11, a first inclined plane is provided on a rear side of the front-rest component 202; a second inclined plane is formed on a front side of the backrest component 300; inclinations of the first and second inclined planes are consistent with the taper portion 5.

As shown in FIGS. 9-17, the rotating locking pin 400 passes through the hole portion formed by the first hole q1 and the second hole q2 and passes through the pin channel 2. The connection portion 4 is inserted into the fitting part 3 and twisted by thread. The rotating locking pin 400 rotates and moves axially. The taper portion 5 compresses the front-rest component 202 and the backrest component 300 due to an expansion of a taper, so that the front-rest component 202 pushes forward against the lip plate body 201 and the backrest component 300 pushes backward against the worn part 100. The worn part 100 and the lip plate body 201 are mutually tightened by opposite lateral forces, thereby achieving a fixation of the worn part 100 and the lip plate body 201.

The first parallel thread y1 and the second parallel thread y2 not only convert a rotational motion of the rotating locking pin 400 into a linear motion, allowing the rotating locking pin 400 to tighten the worn part 100 and the lip plate 200, but also a meshing of the first parallel thread y1 and the second parallel thread y2 can limit an axial displacement of the rotating locking pin 400 due to up and down vibrations in use, thereby ensuring a stability of the connection.

As shown in FIG. 11, a rear inner wall of the first hole q1 is provided with a first protrusion 6 provided on an upper side of the connection groove 1 and a second protrusion 7 provided on a lower side of the connection groove 1. The backrest component 300 includes a vertical support wall 301, an upper limit wall 302 and a lower limit wall 303 provided at an upper end and a lower end of the vertical support wall 301.

In a connection state, the vertical support wall 301 abuts against front end faces of the first protrusion and second protrusion, the upper limit wall 302 is located on an upper side of the first protrusion 6, while the lower limit wall 303 is located on a lower side of the second protrusion 7. The upper limit wall 302 and lower limit wall 303 restrict an upward and downward movement of the backrest component 300, thereby limiting the worn part 100 and lip plate 200 relative to each other in upward and downward directions, thereby avoiding a displacement of the worn part 100 and lip plate 200 in the connection state, further enhancing the firmness of the connection.

Figure 7:
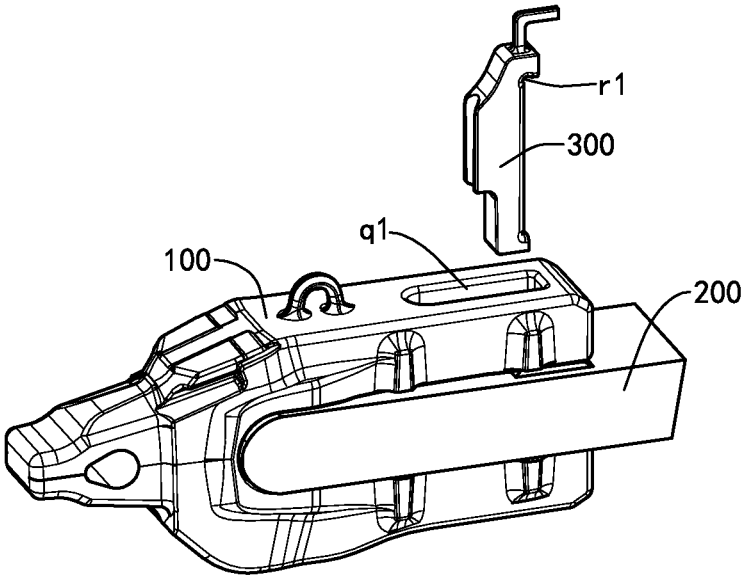
FIG. 7 is a schematic diagram of a backrest component in an insertion state in Embodiment 1 of the present disclosure.
Figure 12:
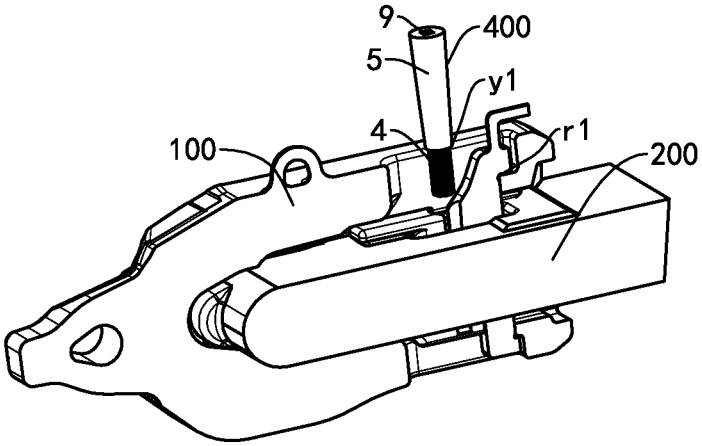
FIG. 12 is a schematic diagram of a rotating locking pin in an insertion state in Embodiment 1 of the present disclosure.
Figure 13:
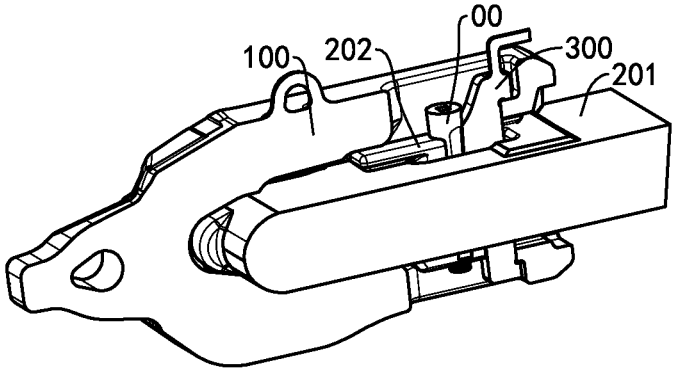
FIG. 13 is a schematic diagram of a stable connection system after the rotating locking pin is twisted in Embodiment 1 of the present disclosure.
Figure 14:
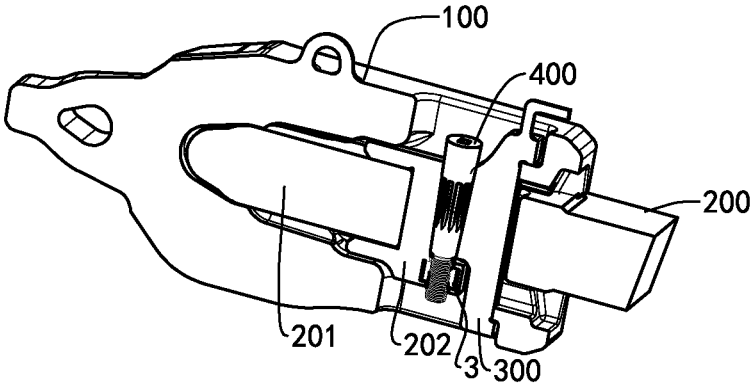
FIG. 14 is an internal diagram of the stable connection system after the rotating locking pin is twisted in Embodiment 1 of the present disclosure.

In an implementation mode, as shown in FIGS. 7, 8, and 12, a second concave portion r1 is provided at rear corner of the vertical support wall 301 and the upper limit wall 302, and rear corners of the vertical support wall 301 and the lower limit wall 303. The providing of the second concave portion r1 not only provides more avoidance space for the backrest component 300 to be inserted into the hole formed by the first hole q1 and the second hole q2, but also avoids a collision between the backrest component 300 and upper edges x1 and lower edges x2 of the first protrusion 6 and the second protrusion 7.

As shown in FIGS. 5 and 18, the front-rest component 202 includes an upper cross arm 21, a vertical arm 22, and a lower cross arm 23. A rear end of the upper cross arm 21 is connected to an upper end of the vertical arm 22, a lower end of the vertical arm 22 is connected to a rear end of the lower cross arm 23 to form a half-frame structure. A lower section at a rear of the vertical arm 22 protrudes backwards to form the fitting part 3, an upper section at the rear of the vertical arm 22 is provided with an acting surface.

As shown in FIGS. 1, 5, 7, and 8, the vertical arm 22 passes through the second hole q2, the upper cross arm 21 is placed between an upper surface of the lip plate body 201 and an upper groove wall m1 of the connection groove 1, the lower cross arm 23 is placed between a lower surface of the lip plate body 201 and a lower groove wall m2 of the connection groove 1. The taper portion 5 compresses the acting surface. of the vertical arm 22, a front side of the vertical arm 22 abuts against an inner wall of the second hole q2.

For a case where the front-rest component 202 and the lip plate body 201 are independent accessories, whether they are connected through welding or other connection structures, or the front-rest component 202 is placed on the lip body 201, the two are not substantially connected and fixed, but the connection is achieved by a subsequent compression force of the rotating locking pin 400. The front-rest component 202 is configured to be the half-frame structure, which can limit its displacement in up and down directions within the lip plate body 201, further enhancing the firmness of an overall connection. In an implementation mode, the front-rest component 202 is pre-fixed to the lip pleat body 201 by welding.

As shown in FIG. 1, an interior of the worn part 100 is respectively provided with an upper concave portion m11 adapted to the upper cross arm 21 and a lower concave portion m12 adapted to the lower cross arm 23, the upper cross arm 21 and the lower cross arm 23 have a fitting gap with the worn part 100, which does not interfere during installation and use.

As shown in FIG. 5, a first concave portion r2 is provided at front corners of the upper cross arm 21 and the vertical arm 22, and at front corners of the lower cross arm and the vertical arm 22. The providing of the first concave portion r2 not only provides more avoidance space for the front-rest component 202 to be inserted into the second hole q2, but also avoids a stress interference between the front-rest component 202 and an outer edge of the second hole q2 of the lip plate body 201 in use.

As shown in FIGS. 5, 8, 10, and 18, in an implementation mode, the first inclined plane at the rear of the front-rest component 202 is the first concave conical surface p1. The first concave cone surface p1 is an acting surface. The second inclined plane at a front side of the backrest component 300 is the second concave conical surface p2. Tapers of the first concave conical surface p1 and the second concave conical surface p2 are consistent with that of the taper portion 5. The first concave conical surface p1 and the second concave conical surface p2 will wrap around an outer circumference surface of the taper portion 5 of the rotating locking pin 400, which is beneficial for improving the connection stability.

As shown in FIGS. 14-15 and 19-22, an anti-loosening locking mechanism is provided between the taper portion 5 of the rotating locking pin 400 and the backrest component 300. Specifically, multiple longitudinal elongated strip-shaped concave grooves 51 are distributed on an outer circumference surface of the taper portion 5 of the rotating locking pin 400. A groove surface of the strip-shaped concave groove 51 transitions to the outer circumference surface of the taper portion 5 in an arc, a protruding elastic locking buckle 52 is provided on the second concave conical surface p2 of the backrest component 300.

In a first state, the rotating locking pin 400 is subjected to an external circumferential force, and the elastic locking buckle 52 slides along the groove surface and enters an adjacent strip-shaped concave groove 51.

In a second state, the external circumferential force is removed, the elastic locking buckle 52 is inserted into a specific strip-shaped concave groove 51 to limit a rotation of the rotating locking pin 400.

A combination of the strip-shaped concave groove 51 and the elastic locking buckle 52 further restricts the circumferential rotation of the backrest component 300 and the rotating locking pin 400 without an external circumferential rotation force, achieving an effect of preventing the loosening of the rotating locking pin 400 and improving the firmness of the connection of the worn part 100.

Figure 22:
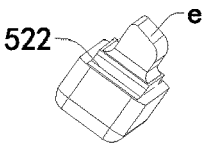
FIG. 22 is a structural schematic diagram of an elastic locking buckle in Embodiment 1 of the present disclosure.
Figure 23:
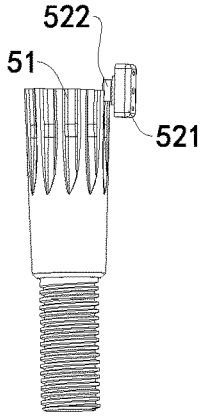
FIG. 23 is a first schematic diagram of a fitting between a strip-shaped concave groove and the elastic locking buckle in Embodiment 1 of the present disclosure.
Figure 24:
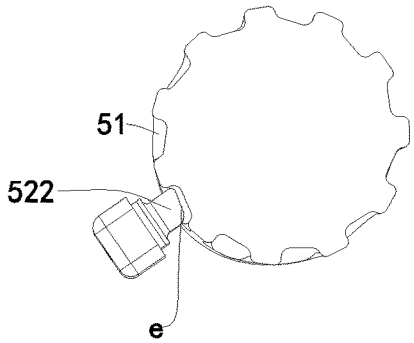
FIG. 24 is a second schematic diagram of a fitting between the strip concave groove and the elastic lock buckle in Embodiment 1 of the present disclosure.
Figure 25:
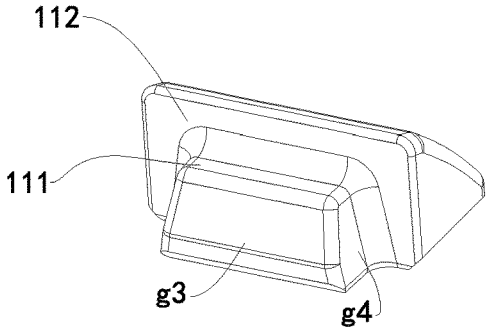
FIG. 25 is a structural schematic diagram of a stabilizing block in Embodiment 1 of the present disclosure.

As shown in FIGS. 22-24, a head of the elastic locking buckle 52 is a tongue-shape slope e that is inclined horizontally, and when tightened, the rotating locking pin 400 rotates clockwise. The elastic locking buckle 52 can easily press into the strip-shaped concave groove 51 through an elastic action. When reversing, due to an action of the tongue-shape slope e, it is necessary to compress an expansion-and-contraction part with more space, which can prevent the rotating locking pin 400 from reversing and reduce looseness during use.

Figure 21:
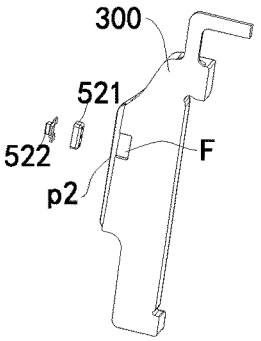
FIG. 21 is a schematic diagram of a decomposition structure of the backrest component in Embodiment 1 of the present disclosure.

As shown in FIG. 21, a groove F is provided on the second concave conical surface p2 of the backrest component 300, the elastic locking buckle 52 includes an elastic member 521 and a metal lock part 522. The elastic member 521 is placed in the groove F, the metal lock part 522 is provided on an outer side of the elastic member 521 to achieve an elastic expansion and contraction. Furthermore, the metal lock part 522 is a worn-resistant component, the elastic part 521 is a rubber component.

Figure 15:
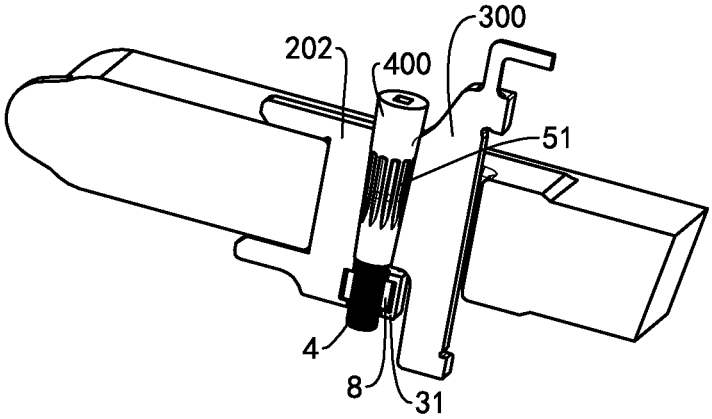
FIG. 15 is an internal component diagram of the rotating locking pin after being twisted in Embodiment 1 of the present disclosure.
Figure 17:
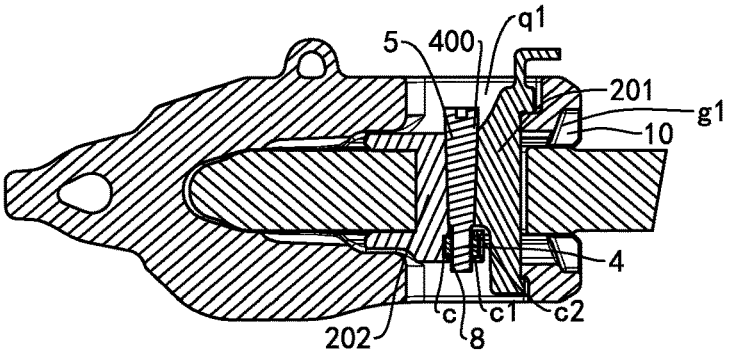
FIG. 17 is a sectional view of the stable connection system after the stabilizing block being inserted in Embodiment 1 of the present disclosure.

As shown in FIGS. 15, 17-18, the fitting part 3 is provided with a nut seat 31, which is provided with an accommodation chamber c and a stabilizing nut 8 in the accommodation chamber c. The stabilizing nut 8 has a certain degree of movement within the nut seat 31, which includes slight movement in horizontal and vertical directions, rendering it to be a fine-tuning component for limiting movement range. Therefore, it can adaptively locate and be matched in thread when the rotating locking pin 400 rotates downwardly and inserted, can also adaptively adjust a relative position after the front-rest component 202 is stretched and displaced, thereby ensuring an adaptability and stability of thread connection.

Specifically, as shown in FIGS. 17-18, an upper seat wall c1 is provided on an upper side of the accommodating chamber c, a lower seat wall c2 is provided on a lower side of the accommodating chamber c. The upper seat wall c1 and the lower seat wall c2 are respectively provided with a through hole, the second parallel thread y2 is provided in the threaded hole of the stabilizing nut 8.

The connection portion 4 is a cylindrical component, the first parallel thread y1 is provided on an outer circumference of the cylindrical component. The connection portion 4 passes through the upper seat wall c1, the stabilizing nut 8, and the lower seat wall c2 in sequence. The upper seat wall c1 and lower seat wall c2 have a function of limiting a detachment of the stabilizing nut 8 from the fitting part 3, while also providing a relative guidance for the front-rest component 202 and the rotating locking pin 400.

In an implementation mode, in the connection state, the connection portion 4 passes through the through-hole of the lower seat wall c2, an annular lower end surface n of the taper portion 5 abuts against the upper seat wall c1, thereby forming a downward restriction to avoid the structure being too tight and inconvenient to disassemble.

Figure 9:
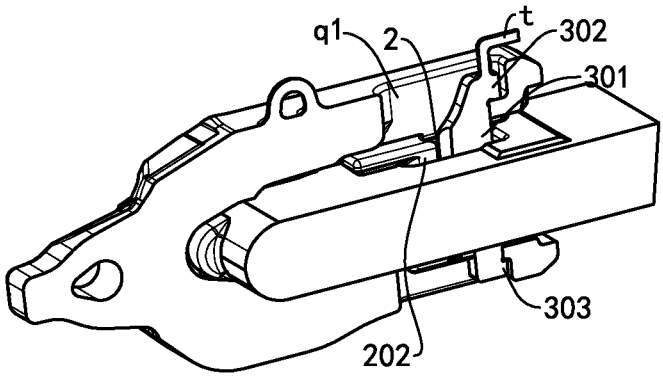
FIG. 9 is an overall schematic diagram of the backrest component after being inserted in Embodiment 1 of the present disclosure.

As shown in FIGS. 9, 11, and 12, in an implementation mode a "7"-shaped member t extending from the first hole q1 at an upper end of the backrest component 300 is convenience to clamp a tool. An upper end face of the rotating locking pin 400 is provided with a screwing part 9 that can be served by a tool. In this embodiment, the twisting portion 9 is a square hole structure, which can be inserted and screwed through a screwing tool with a square cross-section.

Figure 16:
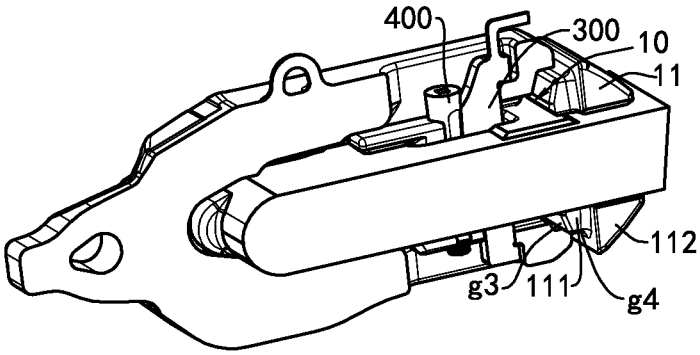
FIG. 16 is a structural diagram of the stable connection system after a stabilizing block being inserted in Embodiment 1 of the present disclosure.

As shown in FIGS. 1-2 and 16, the connection body 102 of the worn part 100 is U-shaped, which includes an upper branch 1011 and a lower branch 1012, a connection groove 1 is formed between the upper branch 1011 and the lower branch 1012. A first hole q1 includes an upper hole of the upper branch 1011 and a lower hole of the lower branch 1012. A stabilizing groove 10 is provided on rear sides of the upper branch 1011 and the lower branch 1012; a stabilizing block 11 is fixedly provided on upper and lower sides of the lip plate 200. The stabilizing block 11 is embedded in the stabilizing groove 10 to stabilize the worn part 100.

As shown in FIGS. 2 and 16, a bottom surface of the stabilizing groove 10 is a first fitting slope g1, sides of the groove on two width edges are a second fitting slope g2 gradually expanding outwardly towards the lip plate 200 direction, so that a cross-section of the stabilizing groove 10 is trapezoidal.

As shown in FIGS. 2, 16, 17, and 25, the stabilizing block 11 is matched with the stabilizing groove 10, which includes a small-sized portion 111 embedded in the stabilizing groove 10 and a large-sized portion 112 limited to a rear end of the worn part 100. A front side of the small-sized portion 111 is a third fitting slope g3 that matches the first fitting slope g1. Two sides of the small-sized portion 111 are a fourth fitting slope g4 that matches the second fitting slop g2. An inclined fit between the stabilizing groove 10 and the stabilizing block 11 minimizes an assembly gap, thereby improving the stability of the connection between the worn part 100 and the lip plate 200. In an implementation mode, the stabilizing block 11 is fixed on the lip plate 200 by welding.

An assembly method of a stable connection system for fixing a worn part 100 of an excavation equipment in this embodiment includes:

step S0: as shown in FIGS. 3-5, a front-rest component 202 passing through the second hole q2 and being connected to the lip plate body 201; the front-rest component 202 closely abutting against a front of an inner wall of the second hole q2, the front-rest component 202 and the lip plate body 201 forming the lip plate 200, the second hole q2 being occupied by the front-rest component 202 to form the second installation hole.

Specifically, a vertical arm 22 of the front-rest component 202 passes through the second hole q2, an upper cross arm 22 is placed on an upper the lip plate body 201, a lower cross arm 23 is placed on a lower side of the lip plate body 201, a front side of the vertical arm 22 abuts against an inner wall of the second hole q2; the front-rest component 202 and the lip plate body 201 together form the lip plate 200.

Figure 6:
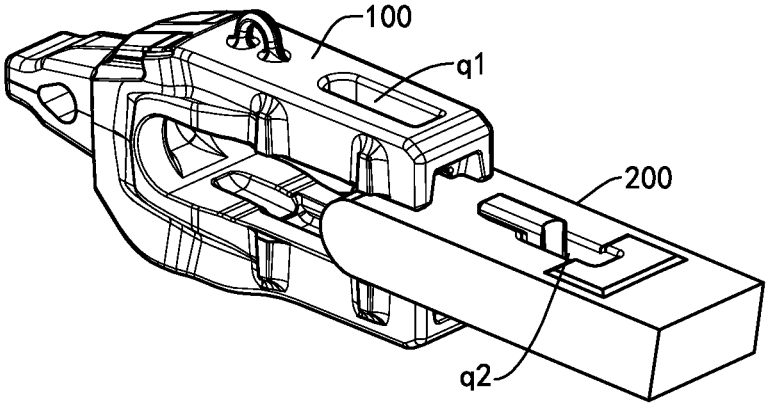
FIG. 6 is a schematic diagram of the worn part and lip plate in Embodiment 1 of the present disclosure.

Step S1: as shown in FIG. 6, a front end of the lip plate 200 extending into a connection groove 1, the second installation hole entering a projection range of a first hole q1; the first hole q1 is a first installation hole, the second installation hole is provided in the first installation hole.

Step S2: as shown in FIGS. 7-11, the backrest component 300 passing through the first installation hole and second installation hole, the backrest component 300 being provided at rear parts of the first installation hole and second installation hole, vertical support wall 301 abutting against front end faces of the first protrusion 6 and second protrusion 7; the upper limit wall 302 being positioned on an upper side of the first protrusion 6, the lower limit wall 303 is provided on a lower side of the second protrusion 7; a pin channel 2 being formed between the first concave conical surface p1 of the vertical arm 22 and the second concave conical surface p2 of the vertical wall 301, a fitting part 3 being provided at a lower part of the pin channel 2.

Step S3: as shown in FIG. 12, the rotating locking pin 400 passing through the first installation hole and the second installation hole and being provided in the pin channel 2 in a way that the connection portion 4 is provided at a lower, the connection portion 4 and a stabilizing nut 8 of the fitting part 4 being adaptively inserted and twisted in a thread manner.

Step S4: as shown in FIGS. 13-17, the rotating locking pin 400 rotating and moving axially, the taper portion 5 compressing the backrest support 300 and the lip plate 200 due to an expansion of a taper, an elastic locking buckle 52 entering a strip-shaped groove 51 and switching between different strip-shaped grooves 51 with the rotation; the worn part 100 being fixed on the lip plate 200.

Step S5: inserting the stabilizing block 11 into the stabilizer groove 10, then fixing with the lip plate 200, and further strengthening a connection between the worn part 100 and the lip plate 200.

Of course, the stabilizing block 11 can also be pre-fixed on the lip plate 200 before step S1; when the lip plate 200 is inserted into the connection groove 1, the stabilizing block 11 is embedded in the stabilizing groove 10. In this way, there is no need to excess step S5 separately. After step S4, the stabilizing block 11 and the stabilizing groove 10 achieve a final state of fitting.

Embodiment 2

This embodiment is a partial improvement on the structure of the lip plate 200 and the backrest component 300 based on Embodiment 1. The following will elaborate on the differences between the two, and briefly describe the similarities. Those skilled in the art can combine this embodiment with Embodiment 1 to restore an overall structure presented in this embodiment.

Figure 26:
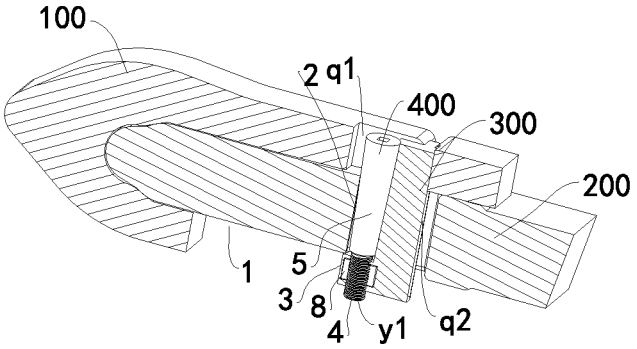
FIG. 26 is a structural schematic diagram of a stable connection system in Embodiment 2 of the present disclosure.

As shown in FIG. 26, this embodiment provides a stable connection system for fixing a worn part of an excavation equipment, which includes a worn part 100, a lip plate 200, a backrest component 300, and a rotating locking pin 400.

In this implementation, the lip plate 200 is an integrated structure, there is no independent front-rest support component as described in Embodiment 1.

As shown in FIG. 26, the worn part 100 is provided with a connection groove 1 with a rear opening, which is configured to extend the lip plate 200 of the equipment to achieve a fitting of the two. The worn part 100 includes a solid tooth tip 101 provided at a front and a connection body 102 provided at a rear with a connection groove 1 axially facing backwards. A first hole q1 extending up and down is provided on a connection body 102. The first hole q1 penetrates the connection groove 1.

As shown in FIG. 26, a structure of the lip plate 200 is adapted to the connection groove 1, so that it can extend into the connection groove 1. At the same time, the lip plate 200 is provided with a second hole q2 that extends up and down, an axis direction of the second hole q2 is same as that of the first hole q1. When a front end of the lip plate 200 extends into the connection groove 1. The second hole q2 is positioned in the first hole q1. A longitudinal space of the first hole q1 is greater than the longitudinal space of the second hole q2, thereby forming a longitudinal hole structure.

The backrest component 300 passes through the first hole q1 and the second hole q2, is provided at rear positions of the first hole q1 and the second hole q2, will ultimately be abutted against a hole wall at a rear of the first hole q1. A pin channel 2 is formed between a front side of the backrest component 300 and an inner wall of the second hole q2 that is not obstructed by the backrest component 300.

In this embodiment, a lower end of the backrest component 300 is provided with a fitting part 3 provided on a lower side of the second hole q2, the fitting part 3 is provided on a lower side of the pin channel 2 for fitting with a lower end of the rotating locking pin 400.

A structure of the rotating locking pin 400 is the same as that of Embodiment 1, which includes a connection portion 4 with a first parallel thread y1 and a taper portion 5 with an outer diameter gradually decreasing from a top to a bottom. The connection portion 4 is a cylindrical component, the first parallel thread y1 is an external thread on its outer circumference.

A specific structure of the fitting part 3 refers to Embodiment 1, where a stabilizing nut 8 is provided through an accommodating chamber c of the nut seat 31, a second parallel thread is provided on a threaded hole wall of the stabilizing nut 8.

The rotating locking pin 400 is formed through the first hole q1 and the second hole q2 and is inserted between the backrest component 300 and the lip plate 200. The connection portion 4 is inserted into the fitting part 3 and twisted in a thread manner. The rotating locking pin 400 rotates and moves axially. The taper portion 5 compresses the backrest component 300 and a front inner side of the second hole q2 by an expansion of a taper, thereby tightening the backrest component 300 and the lip plate 200, and fixing the worn part 100 on the lip plate 200.

The first parallel thread y1 and the second parallel thread not only convert a rotational motion of the rotating locking pin 400 into a linear motion, allowing the rotating locking pin 400 to expand and tighten the worn part 100 and lip plate 200, but also limit an axial displacement of the rotating locking pin 400 due to up and down vibrations during use, thereby ensuring the stability of the connection.

Except for the structures mentioned above, the other structural features are basically the same as those in Embodiment 1. Especially, an anti-loosening locking mechanism is provided between the taper portion 5 of the rotating locking pin 400 and the backrest component 300, a specific structure of the anti-loosening locking mechanism is consistent with Embodiment 1.

Embodiment 3

This embodiment is a partial improvement on the structure of the front-rest component 202 and the backrest component 300 based on Embodiment 1. The following will elaborate on the differences between the two, and briefly describe the similarities. Those skilled in the art can combine this embodiment with Embodiment 1 to restore an overall structure presented in this embodiment.

Figure 27:
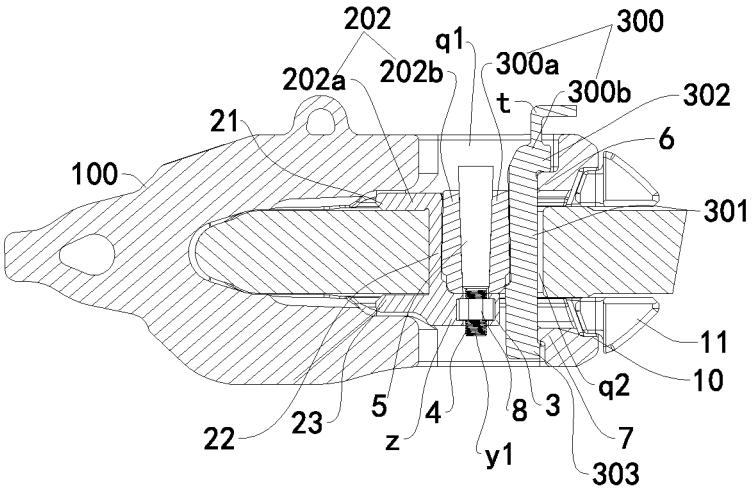
FIG. 27 is a structural schematic diagram of a stable connection system in Embodiment 3 of the present disclosure.

As shown in FIG. 27, in this embodiment, the front-rest component 202 in Embodiment 1 is deformed, the front-rest component 202 is transformed from an original integrated component into a composite component which includes a fixed member 202*a* on a front side and a first rotating support member 202*b* on a rear side.

Simultaneously deform the backrest component 300. In this embodiment, the backrest component 300 includes a second rotating support member 300*a* on a front side and an insertion member 300*b* on a rear side.

A front side of the first rotating support member 202*b* abuts against a rear side of the fixed member 202*a* in a connection state, a front side of the fixed member 202*a* abuts against a front inner hole wall of the second hole q2 in the connection state. A rear side of the first rotating support member 202*b* is an acting surface that fits with the rotating locking pin 400, in an implementation mode, a first concave cone surface p1 is the acting surface.

A rear side of the second rotating support member 300*a* abuts against a front side of an insertion member 300*b* in the connection state, a rear side of the insertion member 300*b* abuts against a rear inner hole wall of the first hole q1 in the connection state. A front side of the second rotating support member 300*a* is matched with the rotating locking pin 400, in an implementation mode, a second concave conical surface p2 matches with the rotating locking pin 400.

A pin channel 2 is formed between the first rotating support member 202*b* and the second rotating support member 300*a*. A structure of the rotating locking pin 400 is the same as that of Embodiment 1, which includes an upper taper portion 5 and a lower connection portion 4, the connection portion is provided with a first parallel thread y1. In an implementation mode, the connection portion 4 is a cylindrical component, the first parallel thread y1 is an external thread.

A lower rear end of the fixed part 202*a* is provided with an extending protrusion z, an upper surface of the extending protrusion z supports the first rotating support member 202*b*, a rear side of the extending protrusion z exceeds a rear side of the first rotating support member 202*b* to form a rear convex fitting part 3 that is protruded backwards. This fitting part 3 is provided on a lower side of the pin channel 2. At the same time, the second rotating support member 300*a* is provided on an upper side of rear side of the pin channel 2 where the fitting part extends to, the fitting part 3 further plays a role in supporting the second rotating support member 300*a*.

In the connection state, the rotating locking pin 400 moves axially, the taper portion open the first rotating support member 202*b* and the second rotating support member 300*a*, squeezes the fixed member 202*a* and the insertion member 300*b*, thereby fixing the worn part 100 on the lip plate 200.

Similar to Embodiment 1, the fitting part 3 is provided with a nut seat 31, which is provided with an accommodation chamber c and a stabilizing nut 8 in the accommodation chamber c. The stabilizing nut 8 has a certain degree of movement within the nut seat 31, which includes slight movement in horizontal and vertical directions, rendering it is a fine-tuning component for adjusting the movement range. Therefore, it can adaptively be positioned and be screw fit when the rotating locking pin 4 rotates downwardly and inserted, can also adaptively adjust a relative position after the front-rest component 202 is stretched and displaced, thereby ensuring the adaptability and stability of thread connection.

Specifically, an upper seat wall c1 is provided on an upper side of the accommodation chamber c, a lower seat wall c2 is provided on a lower side of the accommodation chamber c. The upper seat wall c1 and the lower seat wall c2 are respectively provided with a through hole, the second parallel thread is provided in the threaded hole of the stabilizing nut 8. The connection portion 4 is a cylindrical component, the first parallel thread y1 is provided on an outer circumference of the cylindrical component. The connection portion 4 passes through the upper seat wall c1, the stabilizing nut 8, and the lower seat wall c2 in sequence. The upper seat wall c1 and lower seat wall c2 have a function of limiting the detachment of the stabilizing nut 8 from the fitting part 3, while also providing a relative guidance for the front-rest component 202 and the rotating locking pin 400.

Similar to Embodiment 1, the fixed member 202*a* includes an upper cross arm 21, a vertical arm 22, and a lower cross arm 23. A rear end of the cross arm is connected to an upper end of the vertical arm 22, a lower end of the vertical arm 22 is connected to a rear end of the lower cross arm 23 to form a half-frame structure. The vertical arm 22 passes through the second hole q2, the upper cross arm 21 is provided between an upper surface of the lip body 201 and an upper groove wall of connection groove 1, the lower cross arm 23 is provided between a lower surface of the lip plate body 201 and a lower groove wall of the connection groove 1.

A rear inner wall of the first hole q1 is provided at the first protrusion 6 on an upper side of the connection groove 1 and the second protrusion 7 on a lower side of the connection groove 1. An insertion member 300*b* includes a vertical support wall 301, an upper limit wall 302 and a lower limit wall 303 provided at upper end and a lower end of the vertical support wall 301. The vertical support wall 301 abuts against front end faces of the first protrusion 6 and the second protrusion 7, the upper limit wall 302 is provided on an upper side of the first protrusion 6, the lower limit wall 303 is provided on a lower side of the second protrusion 7. The upper limit wall 302 and the lower limit wall 303 limit an upward and downward movement of the insertion member 300*b*, further enhancing a firmness of the connection.

As shown in FIG. 27, in an implementation mode, a "7"-shaped member that extends from the first hole q1 is provided at an upper end of the insertion member 300*b* for easy to clamp a tool.

In an implementation mode, heights of the first rotating support member 202*b* and the second rotating support member 300*a* are basically flush with each other, upper surfaces thereof are close in height to an upper surface of the fixed member 202*a* when in connection state so as to balance a force at a vertical height and improve the stability.

Except for the structures mentioned above, the other structural features are basically the same as those in Embodiment 1. Especially, an anti-loosening locking mechanism is provided between the taper portion 5 of the rotating locking pin 400 and the second rotating support member 300*a*, a specific structure of the anti-loosening locking mechanism is consistent with Embodiment 1.

This embodiment further provides a structure and an assemble method based on the stable connection system for fixing a worn part 100 of an excavation equipment based on Embodiment 1. Of course, the above method is not the only assembly method for the stable connection system for fixing the worn part 100 of the excavation equipment in this embodiment.

The assembly method of the stable connection system for fixing a worn part 100 of an excavation equipment based on this embodiment specifically includes:

step S10: a fixed member 202*a* passing through a second hole q2 of a lip plate body 201 and being fixedly connected to the lip plate body 201;

step S11: a front end of the lip plate body 201 with a fixed member 202*a* extending into a connection groove 1, a remaining part of the hole after being occupied by the fixed member 202*a* entering a projection range of the first hole q1.

Step S12: an insertion member 300*b* passing through the first hole q1 and the second hole q2, vertical support wall 301 abutting against front-end faces of the first protrusion 6 and the second protrusion 7 of the first hole q1 of the worn part 100, an upper limit wall 302 being provided on an upper side of the first protrusion 6, a lower limit wall 303 being provided on a lower side of the second protrusion 7.

Step S13: inserting the rotating locking pin 400 between the insertion member 300*b* and the fixed member 202*a* in a way that the connection portion 4 is provided at a lower; the connection portion 4 being pre-screwed onto the fitting part 3; at the same time, the connection part 4 and the stabilizing nut 8 of the connection portion 4 and the fitting part 3 being adaptively inserted and twisted in a thread manner; the rotating locking pin 400 retaining enough space for the first rotating support part 202*b* and the second rotating support part 300*a* to insert.

Step S14: the first rotating support member 202*b* being inserted between the rotating locking pin 400 and the fixed member 202*a*; a lower side of the first rotating support member 202*b* being supported by an extending protrusion z of the fixed member 202*a*; the second rotating support member 300*a* being inserted between the rotating locking pin 400 and the insertion member 300*b*, a lower side of the second rotating support member being supported by a part of the extending protrusion z of the fixed member 202*a* that exceeds the rotating locking pin 400.

Step S15: the rotating locking pin 400 rotating and moving axially; the taper portion 5 compressing the first rotating support member 202*b* and the second rotating support member 300*a* due to an expansion of a taper, so that a front side of the first rotating support member 202*b* abutting against the fixed member 202*a*, a rear side of the second rotating support member 300*a* abutting against the insertion member 300*b*; the lip plate body 201 and the worn part 100 being tightened and fixed, the anti-loosening locking mechanism between the taper portion 5 of the rotating locking pin 400 and the second rotating support 300*a* being in a locked state.

Step 16: the stabilizing block 11 being inserted into the stabilizing groove 10, then fixed with the lip plate body 201, further strengthening a connection between the worn part 100 and the lip plate body 201; of course, the stabilizing block 11 can also be pre-fixed to the lip plate body 201 before step S11; when the lip plate body 201 is inserted into the connection groove 1, the stabilizing block 11 is embedded in the stabilizing groove 10; in this way, there is no need to execute step S16; after step S15, the stabilizing block 11 and the stabilizing groove 10 achieving a fitting of a final state.

Of course, it should be understood that there can also be a situation where the lip plate 200 includes a front-rest component 202, which includes a fixed member 202*a* and a first rotating support member 202*b*, the backrest component 300 is an integral component; or the lip plate 200 is an integral component, the backrest component 300 includes the second rotating support 300*a* and the insertion member 300*b*; for those skilled in the art, without departing from the principles of the present disclosure, it is also possible to combine the embodiments for improvement.

Embodiment 4

This embodiment is a partial improvement on a structure of the fitting part 3 and the connection portion 4 based on Embodiment 1; the following will elaborate on the differences between the two, briefly describe the similarities. Technicians in this field can combine this embodiment with Embodiment 1 to restore the overall structure presented in this embodiment. At the same time, a fitting way provided in this embodiment can also be applied to the structures of Embodiments 2 and 3.

Figure 28:
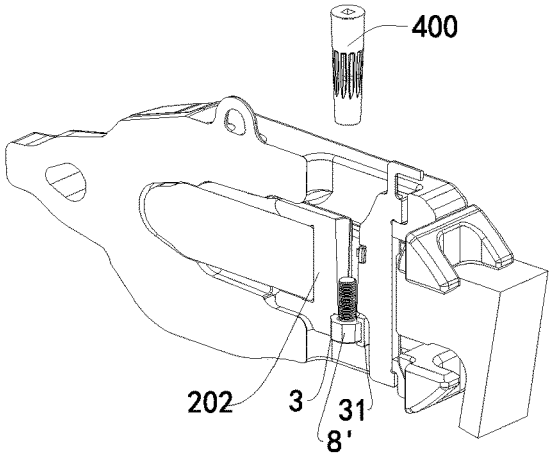
FIG. 28 is a schematic diagram of a decomposition of a stable connection system in Embodiment 4 of the present disclosure.
Figure 29:
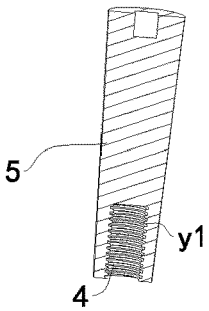
FIG. 29 is a structural schematic diagram of a rotating locking pin in Embodiment 4 of the present disclosure.
Figure 30:
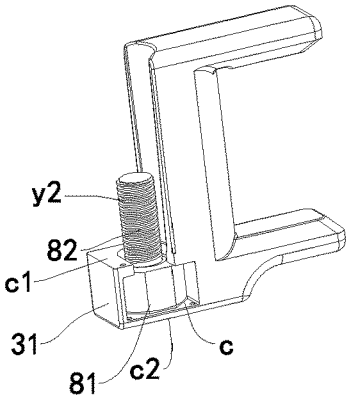
FIG. 30 is a structural schematic diagram of a fitting part in Embodiment 4 of the present disclosure.

As shown in FIGS. 28-30, the fitting part 3 that protrudes at a rear side of the front-rest component 202 is provided with a nut seat 31, which is provided with an accommodation chamber c. A stabilizing screw 8' is provided in the accommodation chamber c. The stabilizing screw 8' includes a nut 81 and a screw 82, the second parallel thread y2 is provided on an outer circumferential surface of the screw 82 of the cylindrical component.

The nut 81 is provided in the accommodation chamber c and is limited by an upper seat wall c1 and lower seat wall c2 of the nut seat 31. The upper seat wall c1 is provided with a through hole, the screw 82 extends upwards from the through hole of the upper seat wall c1.

As shown in FIG. 29, an entity of the rotating locking pin 400 forms a taper portion 5 as a whole, the connection portion 4 is a threaded hole extending from a lower end of the entity towards an interior of the entity. The first parallel thread y1 is provided in this concave threaded hole.

The stabilizing screw 8' has a certain degree of movement within the nut seat 31, which includes slight horizontal and vertical movements, rendering it is a fine-tuning component for limiting the movement rang. Therefore, it can adaptively find its position when the rotating locking pin 400 is twisted downwards and inserted, it can also adaptively adjust a relative position after the front-rest component 202 is stretched and displaced, thereby ensuring an adaptability and stability of a thread connection.

In an implementation mode, in the connection state, the screw 82 penetrates through the through-hole of the lower seat wall c2 and extends into the threaded hole of the rotating locking pin 400. The first parallel thread y1 and the second parallel thread y2 cooperate to achieve a thread twisting, a lower end face of the rotating locking pin 400 abuts against the upper seat wall c1, thereby forming a downward restriction to avoid the structure being too tight and inconvenient to disassemble.

The above introduces the stable connection system and assembly method for fixing the worn part of the excavation equipment provided by the present disclosure. This specification applies specific embodiments to explain the principles and implementation modes of the present disclosure. The above embodiments are only used to help understand the present disclosure and its core ideas. It should be noted that for those skilled in the art, without departing from a principle of the present disclosure, several improvements and modifications can be made to the present disclosure, which also fall within the protection scope of the claims of the present disclosure.

What is claimed is:

1. A stable connection system for fixing a worn part of an excavation equipment, comprising: a worn part, a lip plate body, a front-rest component, a backrest component, and a rotating locking pin;

the worn part is provided with a connection groove with a rear opening and a first hole extending up and down;

the lip plate body is provided with a second hole extending up and down, an axis direction of the second hole is the same as that of the first hole;

a front end of the lip plate body extends into the connection groove; the second hole forms a hole portion in the first hole;

the front-rest component and the backrest component are provided in the hole portion and form a pin channel between the two;

the rotating locking pin comprises a connection portion providing with a first parallel thread and a taper portion with an outer diameter gradually decreasing from a top to a bottom;

a rear of the front-rest component is provided with a fitting part, which is provided with a second parallel thread;

the rotating locking pin is provided in the pin channel through the hole portion, the connection portion and the fitting part are connected in an insertion manner and twisted in a thread manner;

the rotating locking pin rotates and moves axially in the pin channel, the taper portion compresses the front-rest component and backrest component so that front-rest component abuts forward against the lip plate body and the backrest component abuts backward against the worn part, thereby fixing the worn part on the lip plate body, wherein the fitting part is provided with a threaded hole with the second parallel thread; the connection portion is a cylindrical component, the first parallel thread is provided on an outer circumferential surface of the cylindrical component, or the fitting part is provided with a cylindrical component, the second parallel thread is provided on an outer circumferential surface of the cylindrical component, the connection portion is the threaded hole with the first parallel thread at a lower end of the rotating locking pin.

2. The stable connection system for fixing a worn part of an excavation equipment according to claim 1, wherein the front-rest component comprises an upper cross arm, a vertical arm, and a lower cross arm, a rear end of the upper cross arm is connected to an upper end of the vertical arm, a lower end of the vertical arm is connected to a rear end of the lower cross arm to form a half-frame structure;

a lower section at a rear of the vertical arm protrudes backwards to form the fitting part, an upper section at the rear of the vertical arm is provided with an acting surface;

the vertical arm passes through the second hole, the upper cross arm is provided between an upper surface of the lip body and an upper groove wall of the connection groove, the lower cross arm is provided between a lower surface of the lip body and a lower groove wall of the connection groove;

the taper portion compresses the acting surface of the vertical arm, a front side of the vertical arm abuts against an inner wall of the second hole.

3. The stable connection system for fixing a worn part of an excavation equipment according to claim 1, wherein a first concave conical surface is provided on a rear side of the front-rest component; a front side of the backrest component is provided with a second concave conical surface; tapers of the first concave conical surface and the second concave conical surface are consistent with that of the taper portion;

an outer circumference of the taper portion of the rotating locking pin is distributed with multiple strip-shaped concave grooves that are extending longitudinally, a groove surface of the concave groove transitions to an outer circumference of the taper portion in a circular arc; the second concave conical surface of the backrest component is provided with a protruding elastic locking buckle; a head of the elastic locking buckle is provided with a tongue-shaped slope to render it is difficult to rotate in an opposite direction;

in a first state, when the rotating locking pin is subjected to an external circumferential force, the elastic locking buckle slides along the groove surface and enters an adjacent strip-shaped concave groove;

in a second state, when the external circumferential force is removed, the elastic locking buckle is clamped into a specific strip-shaped groove to limit a rotation of the rotating locking pin.

4. The stable connection system for fixing a worn part of an excavation equipment according to claim 1, wherein a rear inner wall of the first hole is provided with a first protrusion on an upper side of the connection groove and a second protrusion on a lower side of the connection groove;

the backrest component comprises a vertical support wall, an upper limit wall and a lower limit wall provided at an upper end and a lower end of the vertical support wall;

the vertical support wall abuts against front-end faces of the first protrusion and the second protrusion, the upper limit wall is provided at an upper side of the first protrusion, the lower limit wall is provided at a lower side of the second protrusion.

5. The stable connection system for fixing a worn part of an excavation equipment according to claim 1, the fitting part is provided with a nut seat, which is provided with an accommodation chamber; an upper side of the accommodation chamber is provided with an upper seat wall, a lower side of the accommodation chamber is provided with a lower seat wall;

the accommodation chamber is provided with a stabilizing nut that can limit a movement range, the stabilizing nut is limited between the upper seat wall and the lower seat wall; or the accommodation chamber is provided with a stabilizing screw that can limit a movement range, a nut of the stabilizing screw is limited between the upper seat wall and the lower seat wall.

6. The stable connection system for fixing a worn part of an excavation equipment according to claim 1, wherein the front-rest component comprises a fixing member on a front side and a first rotating support member on a rear side; the backrest component comprises a second rotating support member on a front side and an insertion member on a rear side;

the rotating locking pin compresses the first and second rotating support members, the first rotating support member compresses the fixing member, the fixing member compresses the lip plate body, the second rotating support member compresses the insertion member backwards, and the insertion member compresses the worn part backwards.

7. An assembly method of a stable connection system for fixing a worn part of an excavation equipment:

wherein an assemble object comprises a worn part, a lip plate, a backrest component, and a rotating locking pin;

the worn part is provided with a connection groove with a rear opening and a first installation hole extending up and down, the lip plate is provided with a second installation hole extending up and down;

the rotating locking pin comprises a connection portion provided with a first parallel thread at a lower side and a taper portion with an outer diameter gradually decreasing from a top to a bottom;

a fitting part is provided on the backrest component or the lip plate, the fitting part is provided with a fine-tuning component for adjusting a movement range; the fine-tuning component is provided with a second parallel thread that matches the first parallel thread;

an outer circumference of the taper portion of the rotating locking pin is distributed with multiple strip-shaped concave grooves extending longitudinally, a protruding elastic locking buckle is provided on a front side of the backrest component;

an assembly step comprises:

step S1: inserting a front end of the lip plate into the connection groove, placing the second installation hole in the first installation hole;

step S2: the backrest component passing through the first installation hole and second installation hole, the backrest component being positioned at rear parts of the first installation hole and the second installation hole, a pin channel being formed between the backrest component and a hole wall of the second installation hole of the lip plate, the fitting part being positioned at a lower part of the pin channel;

step S3: the rotating locking pin passing through the first installation hole and the second installation hole and being provided in the pin channel in a way that the connection portion is provided at a lower; the connection portion and the fine-tunning component of the fitting part being adaptively inserted and twisted in a thread manner;

step S4: the rotating locking pin rotating and moving axially, the taper portion compressing the backrest component and the lip plate due to an expansion of a taper, an elastic locking buckle entering a strip-shaped concave groove and switching between different strip-shaped concave grooves with a rotation of the elastic locking buckle; the worn part being fixed on the lip plate.

8. The assembly method of a stable connection system for fixing a worn part of an excavation equipment according to claim 7, wherein in the assembly object, the lip plate comprises a lip plate body and a front-rest component, the lip plate body is provided with a second hole;

the front-rest component comprises an upper cross arm, a vertical arm, and a lower cross arm; a rear end of the upper cross arm is connected to an upper end of the vertical arm, a lower end of the vertical arm is connected to a rear end of the lower cross arm to form a half-frame structure;

a lower section at a rear of the vertical arm protrudes backwards to form the fitting part, an upper section at the rear of the vertical arm is provided with an acting surface, which is a first concave conical surface;

a rear inner wall of the first installation hole is provided with a first protrusion provided on an upper side of the connection groove and a second protrusion provided on a lower side of the connection groove;

the backrest component comprises a vertical support wall, an upper limit wall and a lower limit wall provided at an upper end and a lower end of the vertical support wall, a front side of the vertical support wall is a second concave conical surface;

in the assembly step, step S0 is comprised before step S1;

in step S0, the vertical arm of the front-rest component passing through the second hole, the upper cross arm being provided on an upper side of the lip plate body, the lower cross arm being provided on a lower side of the lip plate body, a front side of the vertical arm abutting against an inner wall of the second hole, the front-rest component and the lip plate body jointly forming the lip plate;

in step S2, the vertical support wall abutting against front end faces of the first protrusion and the second protrusion, the upper limit wall being provided on an upper side of the first protrusion, the lower limit position wall being provided on a lower side of the second protrusion; the first concave conical surface of the vertical arm and the second concave conical surface of the vertical support wall forming the pin channel.

9. The assembly method of a stable connection system for fixing a worn part of an excavation equipment according to claim 7, wherein in the assembly object, a stabilizing groove is provided on a rear side of the worn part; a bottom surface of the stabilizing groove is a first fitting slope inclined from back to front near the connection groove, a side surface of the stabilizing groove is a second fitting slope gradually expanding outwardly towards a direction of the lip plate; upper and lower sides of the lip plate are respectively provided with a stabilizing block;

in the assembly step, the stabilizing block is pre-fixed on the lip plate before step S1; when the lip plate is inserted into the connection groove, the stabilizing block is embedded in the stabilizing groove; or the stabilizing block is inserted into the stabilizing groove after step S4, and then fixed with the lip plate.

* * * * *